US005593516A

United States Patent [19]

Cassada, III

[11] Patent Number: 5,593,516

[45] Date of Patent: Jan. 14, 1997

[54] HIGH STRENGTH, HIGH TOUGHNESS ALUMINUM-COPPER-MAGNESIUM-TYPE ALUMINUM ALLOY

[75] Inventor: William A. Cassada, III, Richmond, Va.

[73] Assignee: Reynolds Metals Company, Richmond, Va.

[21] Appl. No.: 481,578

[22] Filed: Jun. 7, 1995

Related U.S. Application Data

[62] Division of Ser. No. 267,069, Jun. 27, 1994, which is a division of Ser. No. 937,935, Aug. 28, 1992, Pat. No. 5,376,192.

[51] Int. Cl.[6] ..... C22C 21/16

[52] U.S. Cl. ..... 148/418; 148/417; 148/439; 420/533; 420/534; 420/535; 420/537; 420/538; 420/539; 420/542; 420/548; 420/550; 420/552; 420/553

[58] Field of Search ..... 148/417, 418, 148/439; 420/533, 534, 535, 537, 538, 539, 542, 548, 550, 552, 553

[56] References Cited

U.S. PATENT DOCUMENTS

| | | | |
|---|---|---|---|
| 1,099,561 | 6/1914 | McAdams | 420/539 |
| 2,823,994 | 2/1958 | Rosenkranz et al. | 420/532 |
| 3,414,406 | 12/1968 | Doyle et al. | 420/535 |
| 3,475,166 | 10/1969 | Raffin | 420/532 |
| 4,062,704 | 12/1977 | Sperry et al. | 420/533 |
| 4,063,936 | 12/1977 | Nagase et al. | 420/532 |
| 4,610,733 | 9/1986 | Sanders et al. | 148/417 |
| 4,711,762 | 12/1987 | Vernam et al. | 420/532 |
| 4,772,342 | 9/1988 | Polmear | 148/418 |
| 5,032,359 | 7/1991 | Pickens et al. | 420/533 |

FOREIGN PATENT DOCUMENTS

| | | |
|---|---|---|
| 863262 | 2/1971 | Canada . |
| 2234111 | 1/1974 | Germany . |
| 59-123736 | 12/1982 | Japan . |
| 1089454 | 11/1967 | United Kingdom . |

OTHER PUBLICATIONS

Metallurgical Transactions, vol. 3, No. 1, pp. 191–199, Jan. 1972, J. T. Staley et al.

*Primary Examiner*—David A. Simmons
*Assistant Examiner*—Robert R. Koehler
*Attorney, Agent, or Firm*—Alan M. Biddison

[57] ABSTRACT

An aluminum-based alloy composition having improved combinations of strength and fracture toughness consists essentially of 2.5–5.5 percent copper, 0.10–2.30 percent magnesium, with minor amounts of grain refining elements, dispersoid additions and impurities and the balance aluminum. The amounts of copper and magnesium are controlled such that the solid solubility limit for these elements in aluminum is not exceeded. The inventive alloy composition may also include 0.10–1.00 percent silver for improved mechanical properties. The alloys are useful as high strength, high fracture toughness components for aircraft and aerospace structural parts.

14 Claims, 3 Drawing Sheets

HIGH STRENGTH, HIGH TOUGHNESS ALUMINUM-COPPER-MAGNESIUM-TYPE ALUMINUM ALLOY

This application is a division of Ser. No. 08/267,069 filed Jun. 27, 1994, now allowed, which is a division of Ser. No. 07/937,935, filed Aug. 28, 1992, now U.S. Pat. No. 5,376,192, issued Dec. 27, 1994.

FIELD OF THE INVENTION

This invention relates to an improved aluminum-copper-magnesium alloy and more particularly relates to an aluminum-copper-magnesium alloy which contains silver and is characterized by excellent combinations of mechanical strength and high toughness.

BACKGROUND OF THE INVENTION

In the aircraft and aerospace industries, aluminum alloys are used extensively because of the durability of the alloys as well as the reduction in weight achieved by their use. Alloys useful in aircraft and aerospace applications must have excellent strength and toughness properties. A number of alloys have been developed for these applications. These types of alloys include wrought alloys that have been subjected to various heat treatment and deformation processes to optimize properties for a particular application. However, a continuing need remains in the industry for a high strength, high toughness aluminum alloy which may be useful in a variety of product applications where it may be difficult or inconvenient to apply cold deformation prior to subsequent heat treating processes such as artificial aging treatments. The present invention meets this need in the aircraft and aerospace industries by providing an aluminum alloy which contains critical amounts of copper, magnesium and, preferably, silver. The alloy of the present invention, as a result of the combination of alloying components, has potential applications in a wide variety of areas including forgings, plate, sheet, extrusions, weldable components and matrix material for composite structures.

Aluminum alloys are known in the art which contain magnesium, copper and silver.

Staley et al., in "Metallurgical Transactions", January, 1972, pages 191–199, discusses high strength Al-Zn-Mg-Cu alloys, with and without silver additions. In this publication, Staley et al. studied the effects of silver additions with respect to the heat treating characteristics of high strength alloys. Staley et al. makes reference to a publication by Polmear in "Journal of the Institute of Metals", 1960, Volume 89, pages 51 and 193, who reported that 0.3 to 1% of silver additions substantially increased the strength of Al-Zn-Mg-Cu alloys.

U.S. Pat. No. 3,414,406 to Doyle et al. discloses a copper, manganese and titanium-containing aluminum alloy with the inclusion of 0.1–0.5 weight percent of magnesium. The aluminum alloy also includes from 0.2–0.4 weight percent of silver. Moreover, the aluminum alloy of Doyle et al. requires an amount of silicon between 0.1 to 0.35 percent by weight.

U.S. Pat. No. 4,610,733 to Sanders et al. discloses a high strength, weldable aluminum base alloy characterized by high strength and designed for ballistics armor. The alloy includes 5–7 percent by weight copper and 0.1–0.3 percent by weight of magnesium. The alloy is subjected to processing conditions including cold work equivalent to 6 percent stretching and aging to achieve the desired product properties.

U.S. Pat. No. 4,772,342 to Polmear discloses a wrought aluminum-copper-magnesium-type aluminum alloy having copper in an amount between 5–7 percent by weight, magnesium in an amount between 0.3–0.8 percent by weight, silver in an amount between 0.2–1.0 percent by weight, along with manganese, zirconium, vanadium and the balance aluminum. In illustrated Example 2 of the Polmear patent, an alloy is disclosed containing 5.3 percent by weight of copper and 0.6 percent by weight of magnesium, such a composition exceeding the solubility limit of copper and magnesium in the alloy. Moreover, Polmear does not recognize obtaining the combination of high strength and toughness in these types of aluminum alloys as a result of limiting the amounts of copper and magnesium below the solubility limit.

The present invention is directed to an improved aluminum-copper-magnesium alloy, preferably with silver, having improved combinations of strength and toughness. The alloys of this invention have precise amounts of the alloying components as described herein and provide outstanding combinations of strength and toughness characteristics.

SUMMARY OF THE INVENTION

It is accordingly one object of the present invention to provide an aluminum-based alloy which contains aluminum, copper, magnesium and, preferably, silver that combines high strength and high toughness.

A further object of the present invention is to provide an aluminum based alloy having copper and magnesium amounts below the solubility limit to obtain acceptable levels of strength while providing higher damage tolerance or improved toughness.

It is a still further object of the present invention to provide an aluminum-based alloy having reduced copper levels to facilitate application in alloys for welding use, forgings, cast foil, aircraft component use and matrices for metal matrix composites.

Other objects and advantages of the present invention will become apparent as the description thereof proceeds.

In satisfaction of the foregoing objects and advantages, there is provided by the present invention an aluminum-based alloy consisting essentially of 2.5–5.5 percent by weight of copper, 0.1–2.3 percent by weight of magnesium, optionally 0.1–1.0 percent by weight of silver, and minor amounts of additional alloying elements to control grain structure during hot working operations and grain refinement. The relationship between the amounts of copper and magnesium are such that the solubility limit is not exceeded. The alloy exhibits improved combinations of strength and toughness properties.

BRIEF DESCRIPTION OF DRAWINGS

Reference is now made to the Drawings accompanying the invention, wherein.

DESCRIPTION OF THE PREFERRED EMBODIMENTS

Figure 1:
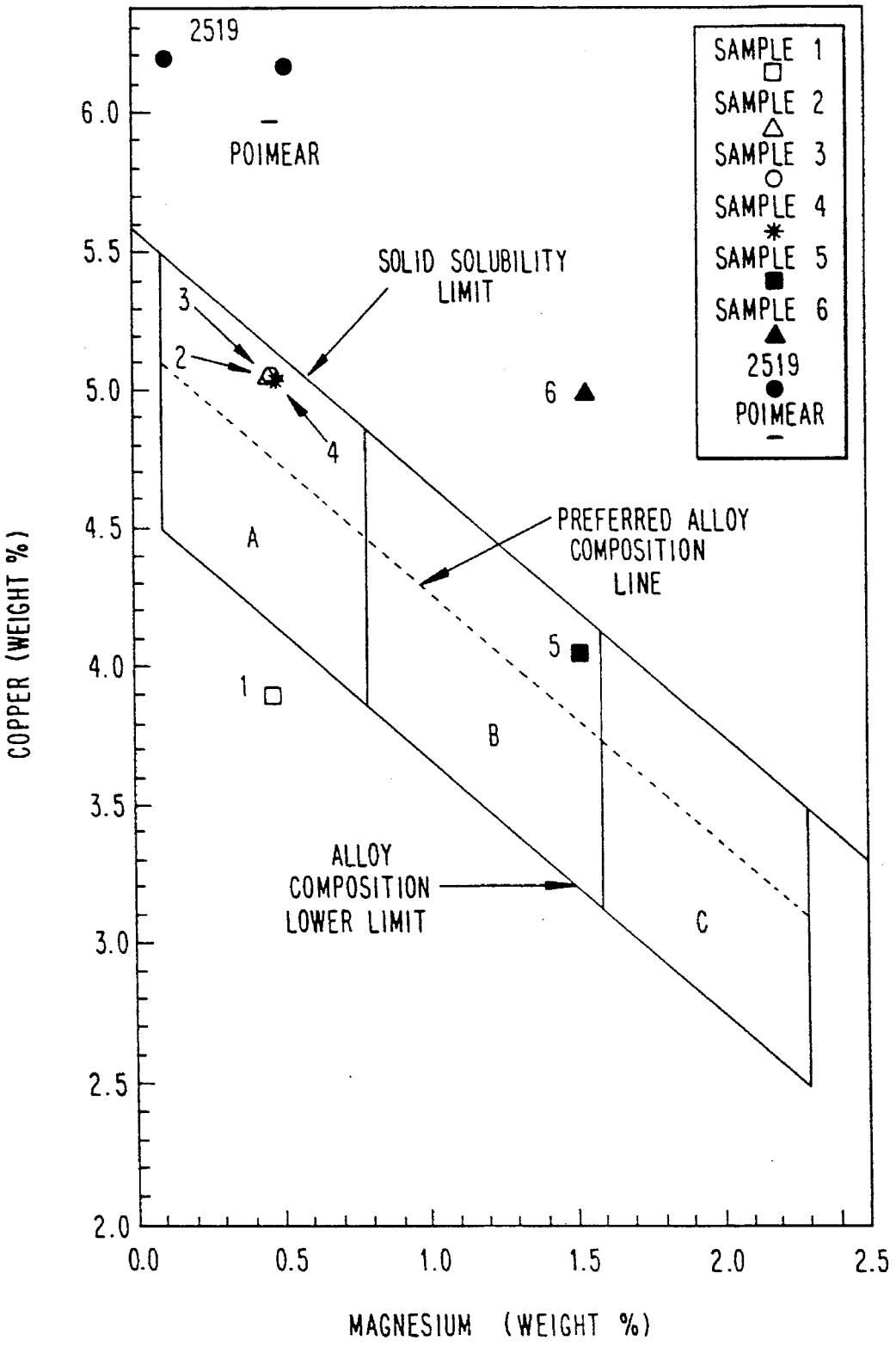
FIG. 1 is a graph showing alloy samples and the compositional range of the inventive alloy with respect to the solid solubility limit line for magnesium and copper in aluminum.

The present invention is directed to an improved aluminum-copper-magnesium alloy having excellent combinations of strength and toughness characteristics. The aluminum-based alloy of the present invention consists essentially of 2.5–5.5 percent by weight copper, 0.10–2.3 percent by weight magnesium, and the balance aluminum, and wherein the total amount of magnesium and copper is such that the solid solubility limit of the alloy is not exceeded. In a preferred embodiment, the alloy includes 0.10–1.0 percent by weight silver. The alloy may also contain minor amounts of dispersoid additions to control alloy grain structure such as at least one of zirconium in an amount up to 0.20 percent by weight, preferably 0.001 to 0.12, vanadium in an amount up to 0.20 percent by weight, preferably 0.001 to 0.12, and manganese in an amount up to 0.80 percent by weight, preferably 0.001 to 0.45. The alloy may also contain grain refiners such as titanium in an amount up to 0.05 percent by weight, preferably 0.001 to 0.05. In addition, the alloy may also contain impurities such as iron and silicon, the maximum amount of iron being about 0.30 percent by weight and the maximum amount of silicon being about 0.25 percent by weight, with a maximum of 0.10 Fe and 0.08 Si being preferred.

In a preferred embodiment, the aluminum-based alloy consists essentially of about 4.8 percent by weight copper, 0.45 percent by weight magnesium, 0.40 percent by weight silver, 0.12 percent by weight zirconium, 0.12 percent by weight vanadium, 0.01–0.02 percent by weight titanium, 0.08 percent by weight iron and 0.06 percent by weight silicon.

In one aspect of the invention, the aluminum-based alloy has the major solute elements of copper and magnesium controlled such that the solubility limit is not exceeded. In this embodiment, an alloy is provided having higher toughness than prior art alloys as a result of a lower volume percent second phase (VPSP) due to lower copper content.

It has been discovered that combinations of both high strength and high toughness are obtained in the alloy of the present invention by controlling the range of composition of the solute elements of copper and magnesium such that the solid solubility limit is not exceeded. As a result of this controlled compositional range, an inventive alloy is provided with levels of strength that are comparable with those of prior art alloys but with improved fracture toughness or damage tolerance.

For the inventive alloy, the high strength and high toughness properties are based upon maximizing the copper and magnesium additions such that all of the solute, i.e. copper plus magnesium, is utilized for precipitation of the strengthening phases. It is important to avoid any excess solute that would contribute to the second phase content of the material and diminish its fracture toughness. In theory, the maximum solute level, copper plus magnesium, should be held to this solubility limit. This limit is described in weight percent by the equation:

$$(1)\ Cu_{max}=-0.91(Mg)+5.59$$

Therefore, an alloy containing 0.1 weight percent magnesium can contain 5.5 maximum weight percent copper without producing undesirable insoluble second phase particles. Similarly, at 2.3 percent by weight magnesium, the maximum copper would be 3.5 weight percent.

In practice, the solute levels must be controlled to just below the solubility limit to avoid second phase particles. This level of control must be done as a result of conventional processing techniques for making these types of alloys. In conventional casting of these types of alloys, microsegregation of copper in the ingot results in local regions of high copper content. If the bulk copper level is close to the solubility limit, these regions will exceed the solid solubility limit and contain insoluble second phase particles.

During solution heat treating operations, furnaces cannot be maintained under true isothermal conditions. As a result, the furnaces must operate within the range of variability in temperature set point. Consequently, the alloy composition must be such that all of the copper and magnesium solute can be put into solid solution given the operating limits of the furnace. As a result of the limitations in intended processing sequencing for these types of alloys, the preferred percentages for copper and magnesium must compensate for the variables discussed above. A preferred solute limit for copper using DC (direct chill) cast ingot and conventional solution heat treating furnaces is described in weight percent by the following equation:

$$(2)\ Cu_{preferred}=-0.91(Mg)+5.2$$

Therefore, an alloy containing 0.1 weight percent magnesium would have a preferred 5.1 weight percent copper. Similarly, at 2.3 percent by weight magnesium, a preferred copper would be 3.1 weight percent.

A minimum copper level, to ensure high strength, can be described in weight percent by the following equation:

$$(3)\ Cu_{min}=-0.91(Mg)+4.59$$

Therefore, an alloy containing 0.1 weight percent magnesium would have a minimum 4.5 weight percent copper. Similarly, at 2.3 percent by weight magnesium, a minimum copper would be 2.5 weight percent.

With reference to Table 1, the composition limits for alloy in accordance with the present invention are depicted. It should be noted, as previously described, the alloys may also contain titanium.

The preferred range for copper is 2.50 to 5.50 weight percent and the preferred range for magnesium is 0.10 to 2.30 weight percent. Additionally, within these ranges, the amounts of copper and magnesium must be interrelated to ensure that the solid solubility limit for any specific composition is not exceeded. When the amounts of copper and magnesium are too high, there is an unacceptable reduction in fracture toughness properties. When the amounts of copper and magnesium are too low, the strength of the alloy is too low.

Even more preferred ranges of copper and magnesium are identified in Table 1 as Range A, Range B and Range C. Within Range A, the predominate precipitate phases are copper-rich. Within Range C, the predominate precipitate phases are magnesium-rich. Range B alloys contain precipitate phases that are both copper and magnesium-rich, as this range is intermediate between Region A and C. In all three alloy regions, both the precipitate composition and distribution can be modified by silver additions.

Precipitate phase composition and distribution effect the properties of products made from the alloys, such as corrosion resistance and mechanical property behavior after exposure to elevated temperature. The particular application for the alloy products would determine the desired precipitate phase to be maximized.

With reference now to FIG. 1, the solid solubility limit is shown plotted against weight percentages of copper and magnesium. The region bounded by the solubility limit, as described by equation 1, and the lower alloy composition limit, as described by equation 3, between the range of 0.1–2.3 wt % magnesium, identifies the ranges and relationships of copper and magnesium for the alloy of the present invention.

In a further aspect of the invention, it has been discovered that silver may be added to the alloy to enhance strength developed from solution heat treatment followed by artificial aging (hereinafter "T6 strength"). The addition of silver to the inventive alloy produces the same strength, without cold deformation prior to aging, as a silver-free alloy does with 4–8 percent cold reduction prior to aging. Moreover, the addition of silver to the inventive alloy composition does not appear to unacceptably diminish fracture toughness.

Besides controlling the total amount of copper and magnesium to below the solubility level and adding silver to the inventive alloy composition, dispersoid additions may be made to control alloy grain structure during hot working operations such as hot rolling, forging, extrusion, etc. Moreover, the dispersoid additions can add to the total alloy strength and stability.

One dispersoid addition may be zirconium which inhibits grain recrystallization by forming $Al_3Zr$ particles. Another dispersoid addition, vanadium, may be added in order to modify the $Al_3Zr$ particles by substitution of zirconium with vanadium in the crystal lattice. The resulting $Al_3(Zr,V)$ particles have greater thermal stability during homogenization and solution heat treatment.

Manganese, in addition to or in place of the zirconium and/or vanadium, may also be added to improve the alloy grain structure. However, manganese may also add to the second phase content of the final product which results in lower fracture toughness. As a result, the addition of manganese to the inventive alloy must be determined based upon the intended application.

The zirconium may range up to maximum of 0.20 weight percent, with a preferred target value being about 0.12 percent by weight. The vanadium may also range up to a maximum of 0.20 percent by weight, with a target value being the same as that for zirconium.

Manganese may range between 0.00 percent and up to a maximum of 0.80 percent by weight. A preferred range for manganese, when present, is between 0.001 and 0.45 percent by weight.

Grain refining alloy additions may also be made to the inventive alloy composition. Titanium may be added during DC casting in order to modify the as-cast grain shape and size. It is desirable to use only enough titanium to provide a reasonable level of grain size. Excess titanium additions are to be avoided because they contribute to the insoluble second phase content of the alloy. Titanium may range up to a maximum of 0.05 percent by weight, with a preferred range of 0.01–0.02 percent by weight.

The inventive alloy composition also includes other elemental species as impurities. Ideally, impurities should be limited to as low as economically possible, with the impurity level of individual elements (other than iron and silicon) being less than 0.05 percent by weight and the total impurity level being less than 0.15 percent by weight. Major impurities in aluminum are iron and silicon which can have a deleterious effect on fracture toughness. The iron in the inventive alloy should not exceed 0.15 weight percent maximum, with a preferred maximum target value of 0.08 percent by weight. Silicon should not exceed 0.10 percent by weight with a preferred target maximum of 0.06 percent by weight.

The alloys of the present invention may be prepared in accordance with conventional methods known to the art. Preferably, in one embodiment, the components of the alloy are mixed and formed into a melt. The melt is then cast to form a billet or ingot for processing. The billet or ingot can be mechanically worked by means known in the art such as rolling, forging, or extruding to form products. As indicated, the alloys are particularly suitable as aircraft and aerospace components such as aircraft skins and structural members which are required to withstand complex stress at elevated temperatures for long periods. After working, the products may be solution heat treated at elevated temperatures followed by quenching and then natural and/or artificially aging.

It is recognized that prior patents and publications contain broad disclosures of aluminum-based alloys which contain the components of the alloy of this invention. However, none of the prior art describes alloys that contain all of the critical components of the alloy of this invention in the critical combination as set forth hereinabove. According to this invention, it has been discovered that the amounts of copper and magnesium, as well as the relationship between the amounts, are critical and essential to provide an aluminum-based alloy which has excellent combinations of mechanical strength and fracture toughness. According to the present invention, maintaining the combination of copper and magnesium amounts in the alloy below the solid solubility limit provides a combination of both high strength and high fracture toughness.

In order to further describe the alloy of the present invention and the effects of controlling the copper and magnesium content below the solubility limit and the effect of the addition of silver to these types of alloys, the following samples are provided. These samples are presented to illustrate the invention but are not to be considered as limiting. In the experimental results, parts are by weight unless otherwise indicated. In preparing the inventive alloy compositions to illustrate the improvements in mechanical properties, 3 inch×8 inch ingots, of the compositions listed in Table 2, were cast.

All of the ingots, except samples 5 and 6, were batch homogenized by heating at 50° F. per hour to between 980°–990° F. and soaked for 36 hours. Samples 5 and 6 were homogenized between 920°–930° F. After cooling, the ingots were scalped 0.125 inches on each side and preheated to between 870°–875° F. On reaching the preheat temperature, the ingots were cross-rolled to ten inch width followed by straight rolling to 0.400 inch gauge. The slabs were reheated to 870° F. when the rolling temperature fell below 700° F.

Samples of the fabricated plates were solution heat treated (SHT) for 1 hour using two different temperatures. Samples 1–4 were solution heat treated for 1 hour at 985° F., samples 5–6 were solution heat treated for 1 hour at 925° F. All of the samples were cold water quenched following heat treatment. One sample from each plate composition was stretched 1 percent within one hour of quenching and aged for 12 hours at 350° F. This practice, one percent stretch plus 12 hours/360° F., was identified as T651. Similarly, one sample from each plate composition, except samples 5–6, was stretched seven percent within one hour of quenching and aged for 12 hours at 350° F. This practice was identified as T87.

Figure 2A:
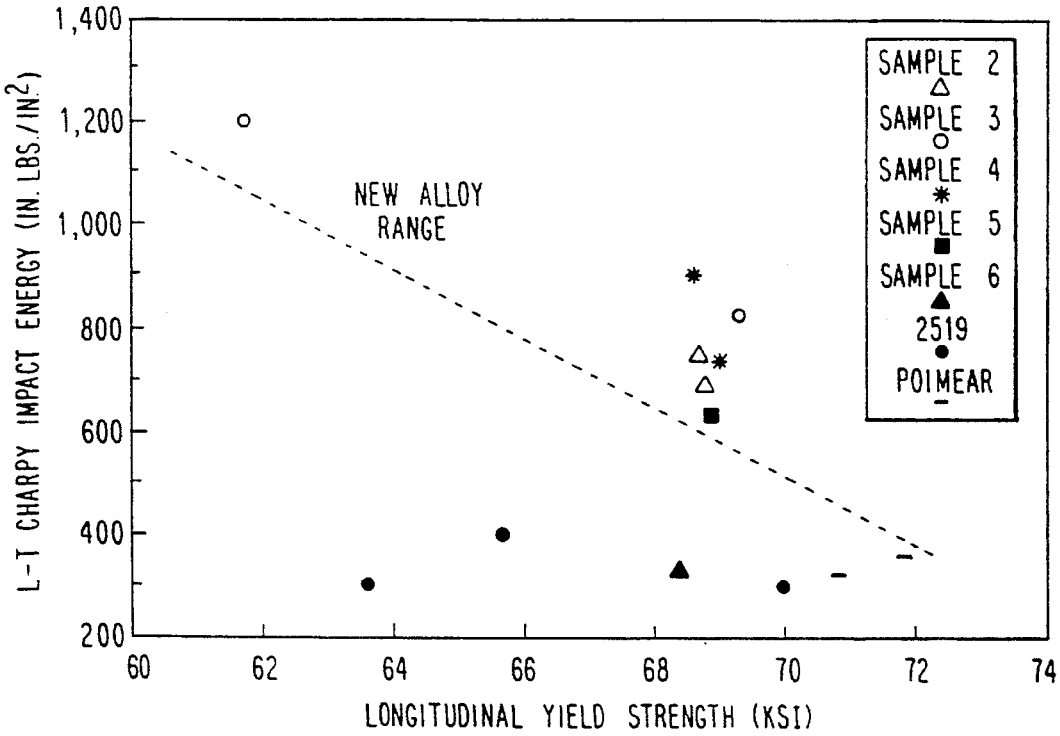
FIGS. 2*a* and 2*b* are graphs showing the relationship between CIE (Charpy Impact Energy) fracture resistance and yield strength, for various samples of the inventive alloy and prior art alloys, in two test orientations.
Figure 2B:
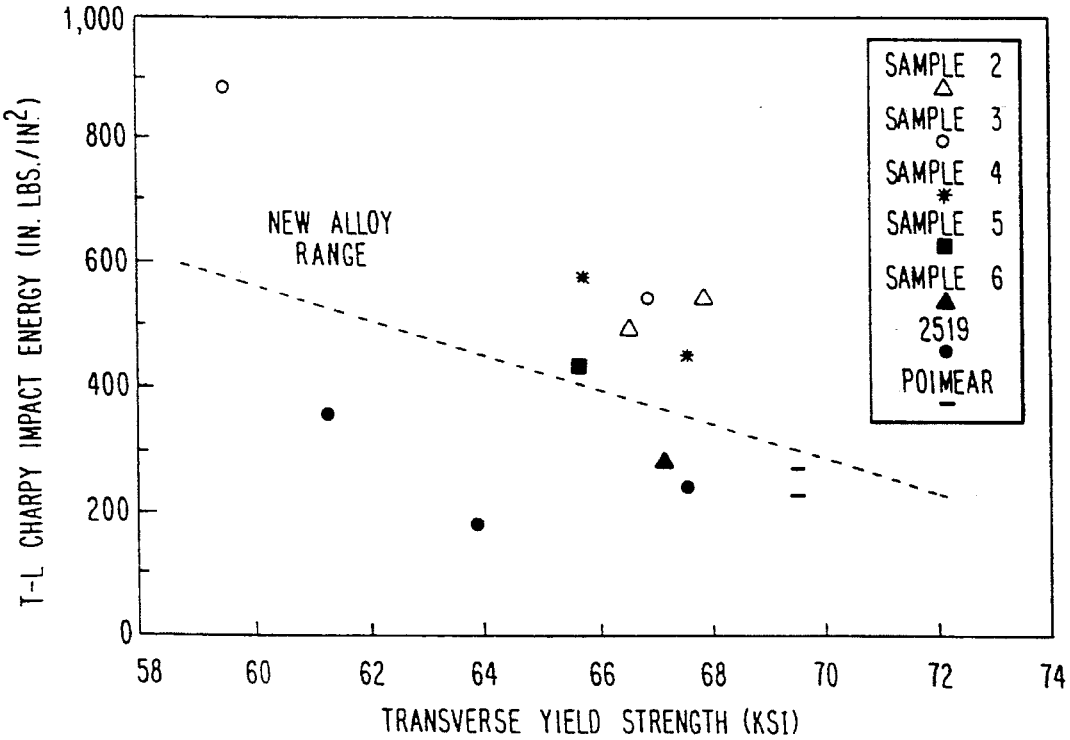
Figure 3A:
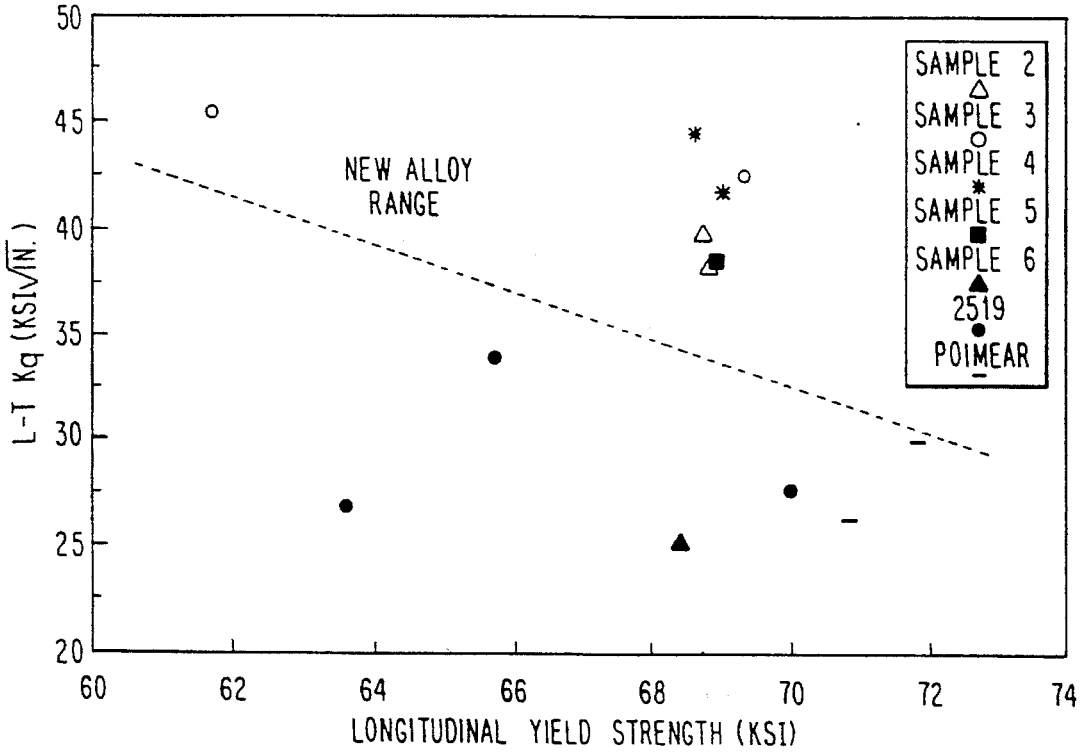
FIGS. 3*a* and 3*b* are graphs showing the relationship between Kq fracture toughness and yield strength, for various examples of the inventive alloy and existing alloys, in two test orientations.
Figure 3B:
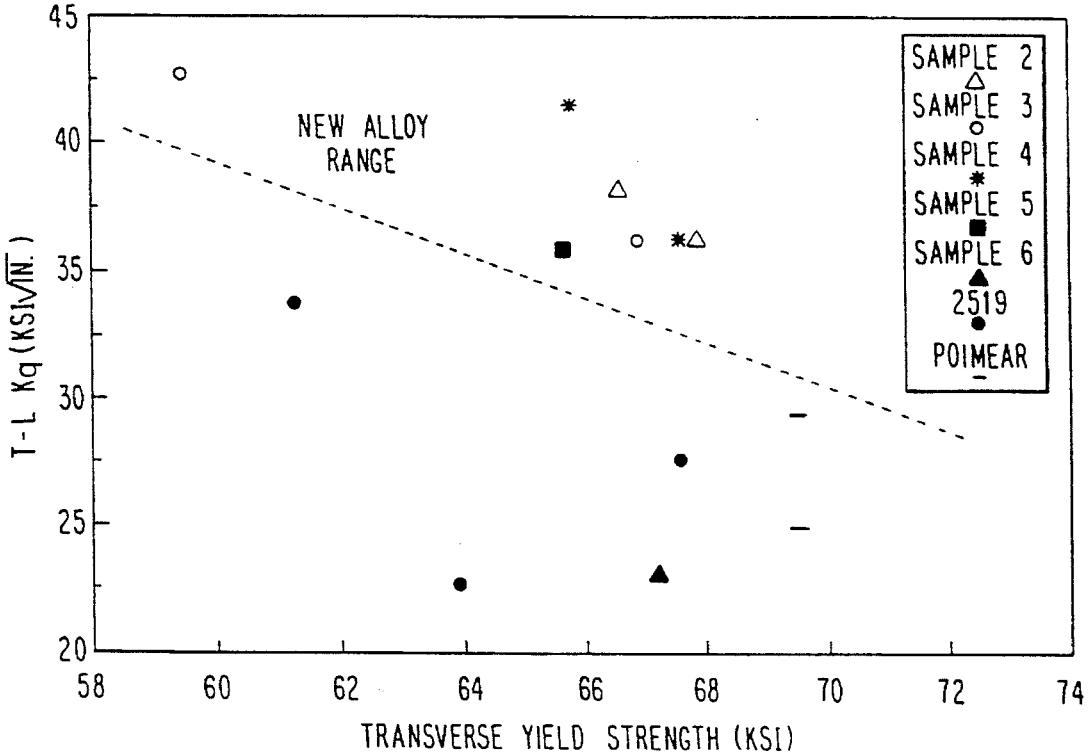

Longitudinal and transverse tensile testing of each plate sample, T651 and T87, was performed in duplicate using standard 0.250 inch round specimens. Conventional L-T and T-L Charpy Impact Energy (CIE) and Fracture Toughness (Kq) testing was performed in duplicate using standard specimens. The average mechanical test results are shown in Table 3 for the T651 and T87 tempers. The relationship between CIE fracture resistance and yield strength for all of the various alloy/temper combinations is shown in FIG. 2. Similarly, the relationship between the alloy fracture toughness (Kq) and yield strength is shown in FIG. 3.

Inspection of FIGS. 1–3 allows the alloy samples to be characterized as follows:

Sample 1: Contains insufficient copper, falls outside of inventive alloy copper range for 0.5 wt % magnesium alloy. Strength too low.

Samples 2–5: Samples fall within inventive range for copper and magnesium. These alloys show best combinations of strength and toughness in FIGS. 2 and 3.

Sample 6: Contains excess copper, falls outside of inventive alloy copper range for 1.5 wt % magnesium alloy. Toughness too low.

2519 Examples: Contain excess copper, fall outside of inventive alloy copper range for 0.1–0.5 wt % magnesium alloy. Toughness too low.

Polmear Example: Contains excess copper, falls outside of inventive alloy copper range for 0.1–0.5 wt % magnesium alloy. Toughness too low.

The alloy composition of the present invention provides a wide variety of potential applications due to improvements in the combination of strength and toughness characteristics. Due to the similarity of the inventive alloy to known AA2219, it can be used for aerospace tankage. The inventive alloy is considerably stronger than the known AA2219 alloy which would permit down gauging of the tank walls. Moreover, the silver-containing alloy develops higher T6 properties than the known AA2519 which would also permit use in aerospace tankage application.

The high T6 properties of the silver-containing alloys of the present invention, as compared with the T8 properties, also make it applicable for use in forgings where it is often not feasible to introduce cold work prior to aging. The inventive alloy is similar in strength to AA2014-T6 which is commonly used in forging applications. The inventive alloy should exhibit improved fracture toughness and fatigue properties as a result of the controlled compositional limits.

The inventive alloy may also be used in aerospace applications such as creep-formed wingskins or aircraft body sheet. The improved damage tolerance or fracture toughness of the inventive alloy along with the highly stable microstructure make it an attractive candidate for applications subjected to creep and elevated temperature. The inventive alloy could also be produced in thin strip for use in high strength honeycomb structures due to its high T6 properties. The inventive alloy may also be a candidate for a high strength matrix material in metal matrix composites due to the lower solute level than prior art alloys.

As such, an invention has been disclosed in terms of preferred embodiments thereof which fulfill each and every one of the objects of the present invention as set forth hereinabove and provide a new and improved aluminum-based alloy composition having improved combinations of strength and fracture toughness.

Of course, various changes, modifications and alterations of the teachings of the present invention may be contemplated by those skilled in the art without departing from the intended spirit and scope thereof. Accordingly, it is intended that the present invention only be limited by the terms of the appended claims.

TABLE 1

Composition limits (weight percent) for invention alloys, Polmear patent, and AA2519.

| | Si | Fe | Cu | Mn | Mg | Ag | V | Zr | Others Each | Others Total |
|---|---|---|---|---|---|---|---|---|---|---|
| Preferred Range | | | | | | | | | | |
| Min: | — | — | 2.50 | 0.00 | 0.10 | 0.00 | 0.00 | 0.00 | — | — |
| Max: | 0.25 | 0.30 | 5.50 | 0.80 | 2.30 | 1.00 | 0.20 | 0.20 | 0.05 | 0.15 |
| Range A | | | | | | | | | | |
| Min: | — | — | 3.85 | 0.00 | 0.10 | 0.10 | 0.05 | 0.05 | — | — |
| Max: | 0.25 | 0.30 | 5.50 | 0.60 | 0.80 | 1.00 | 0.15 | 0.15 | 0.05 | 0.15 |

TABLE 1-continued

Composition limits (weight percent) for invention alloys, Polmear patent, and AA2519.

| | Si | Fe | Cu | Mn | Mg | Ag | V | Zr | Others Each | Others Total |
|---|---|---|---|---|---|---|---|---|---|---|
| Range B | | | | | | | | | | |
| Min: | — | — | 3.15 | 0.00 | 0.80 | 0.10 | 0.05 | 0.05 | — | — |
| Max: | 0.25 | 0.30 | 4.85 | 0.60 | 1.60 | 1.00 | 0.15 | 0.15 | 0.05 | 0.15 |
| Range C | | | | | | | | | | |
| Min: | — | — | 2.50 | 0.00 | 1.60 | 0.10 | 0.05 | 0.05 | — | — |
| Max: | 0.25 | 0.30 | 4.15 | 0.60 | 2.30 | 1.00 | 0.15 | 0.15 | 0.05 | 0.15 |
| Polmear | | | | | | | | | | |
| Min: | — | — | 5.00 | 0.30 | 0.30 | 0.20 | 0.05 | 0.10 | — | — |
| Max: | 0.10 | — | 7.00 | 1.00 | 0.80 | 1.00 | 0.15 | 0.25 | 0.05 | 0.15 |
| AA2519 | | | | | | | | | | |
| Min: | — | — | 5.30 | 0.10 | 0.05 | — | 0.05 | 0.10 | — | — |
| Max: | 0.25 | 0.30 | 6.40 | 0.50 | 0.40 | — | 0.15 | 0.25 | 0.05 | 0.15 |

TABLE 2

Compositional analysis of various experimental alloys, plus 2519 and Polmear examples.

| Alloy Type | Fe | Si | Cu | Mn | Mg | Ag | V | Zr | VPSP |
|---|---|---|---|---|---|---|---|---|---|
| Alloy Sample 1 | 0.05 | 0.04 | 3.91 | — | 0.49 | 0.47 | 0.13 | 0.15 | 1.50 |
| Alloy Sample 2 | 0.05 | 0.04 | 5.04 | — | 0.51 | 0.49 | 0.13 | 0.14 | 1.42 |
| Alloy Sample 3 | 0.05 | 0.04 | 5.06 | 0.49 | 0.53 | — | 0.13 | 0.14 | 1.83 |
| Alloy Sample 4 | 0.05 | 0.04 | 5.01 | 0.47 | 0.52 | 0.49 | 0.13 | 0.14 | 1.81 |
| Alloy Sample 5 | 0.01 | 0.02 | 4.07 | — | 1.52 | 0.53 | — | 0.11 | 1.90 |
| Alloy Sample 6 | 0.01 | 0.02 | 4.91 | — | 1.61 | 0.50 | — | 0.11 | 3.79 |
| 2519 - Example 1 | 0.05 | 0.04 | 6.15 | 0.48 | 0.53 | — | 0.12 | 0.14 | 3.07 |
| 2519 - Example 2 | 0.12 | 0.05 | 6.18 | 0.16 | 0.11 | — | 0.09 | 0.11 | 3.98 |
| Polmear - Example | 0.05 | 0.04 | 5.95 | 0.47 | 0.51 | 0.49 | 0.12 | 0.14 | 2.87 |

Units: weight percent

TABLE 3

Mechanical properties for various experimental alloys, plus 2519 and Polmear examples, in T651 and T87 tempers.

| Alloy Type | Temper | UTS[1] L | TYE[1] L | % E L | UTS[1] LT | TYE[1] LT | % E LT | CIE[2] L—T | CIE[2] T—L | Kq[3] L—T | Kq[3] T—L |
|---|---|---|---|---|---|---|---|---|---|---|---|
| Alloy Sample 1 | T651 | 64.5 | 58.7 | 17.0 | 63.2 | 56.4 | 16.5 | 2310 | 1751 | 47.4 | 45.4 |
| | T87 | 64.7 | 59.7 | 17.5 | 64.8 | 58.7 | 15.0 | 2211 | 1545 | 47.9 | 46.7 |
| Alloy Sample 2 | T651 | 74.3 | 68.7 | 13.0 | 73.6 | 66.5 | 12.0 | 757 | 494 | 39.9 | 38.2 |
| | T87 | 73.8 | 68.8 | 15.0 | 74.3 | 67.9 | 12.0 | 698 | 544 | 38.4 | 36.3 |
| Alloy Sample 3 | T651 | 69.9 | 61.7 | 18.5 | 70.2 | 59.5 | 13.0 | 1201 | 881 | 45.5 | 42.7 |
| | T87 | 73.3 | 69.3 | 15.5 | 73.9 | 66.9 | 10.0 | 833 | 545 | 42.7 | 36.3 |
| Alloy Sample 4 | T651 | 74.1 | 68.6 | 15.0 | 73.2 | 65.8 | 11.5 | 908 | 576 | 44.7 | 41.5 |
| | T87 | 73.2 | 69.0 | 16.5 | 74.2 | 67.6 | 11.0 | 742 | 455 | 42.0 | 36.4 |
| Alloy Sample 5 | T651 | 73.0 | 68.9 | 15.0 | 74.4 | 65.7 | 11.0 | 638 | 435 | 38.7 | 35.9 |
| Alloy Sample 6 | T651 | 72.8 | 68.4 | 13.0 | 73.9 | 67.2 | 10.0 | 332 | 282 | 25.3 | 23.1 |
| 2519 - Example 1 | T651 | 71.9 | 65.7 | 13.0 | 71.1 | 61.3 | 12.5 | 401 | 359 | 34.0 | 33.8 |
| | T87 | 73.9 | 70.0 | 13.0 | 74.5 | 67.6 | 11.0 | 302 | 242 | 27.9 | 27.7 |
| 2519 - Example 2 | T87 | 69.0 | 63.6 | 11.0 | 69.8 | 63.9 | 8.8 | 305 | 182 | 26.9 | 22.7 |
| Polmear -Example | T651 | 77.0 | 71.8 | 13.0 | 76.6 | 69.5 | 11.0 | 364 | 274 | 30.3 | 29.5 |
| | T87 | 75.2 | 70.8 | 14.0 | 76.1 | 69.5 | 10.5 | 326 | 232 | 26.6 | 25.0 |

Units:
[1]ksi
[2]in. lb. per in$^2$
[3]ksi $\sqrt{\text{in}}$

What is claimed is:

1. An aluminum-based alloy having an improved combination of high strength and high fracture toughness, said alloy consisting essentially of:

about 2.5–5.5% by weight of copper;

about 0.10–2.30% by weight of magnesium; and the balance aluminum and incidental impurities;

wherein the amounts of copper and magnesium together are less than the solid solubility limit for copper and magnesium in aluminum and are interrelated by the following equations:

$$Cu_{max}=-0.91\ Mg+5.59$$

$$Cu_{min}=-0.91\ Mg+4.59.$$

2. The aluminum-based alloy of claim 1, further including up to 0.20% by weight of zirconium.

3. The aluminum-based alloy of claim 1, further including up to 0.20% by weight of vanadium.

4. The aluminum-based alloy of claim 1, further including up to 0.80% by weight of manganese.

5. The aluminum-based alloy of claim 1, further including up to 0.05% titanium.

6. The aluminum-based alloy of claim 1, further including up to 0.15% by weight of iron and 0.10% by weight of silicon.

7. The aluminum-based alloy of claim 1 wherein said amounts of copper and magnesium are determined according to the equation:

$$Cu=-0.91(Mg_{wt\ \%})+5.2$$

8. The aluminum-based alloy of claim 1 which consists essentially of about 4.8% by weight copper, about 0.45% by weight magnesium, about 0.12% by weight of zirconium, about 0.12% by weight of vanadium, about 0.01 to 0.02% by weight of titanium and the balance aluminum.

9. The aluminum-based alloy of claim 8 further including an amount of manganese between 0.00 and 0.45% by weight.

10. The aluminum-based alloy of claim 8 further including up to 0.15% by weight of iron and up to 0.10% by weight of silicon.

11. The aluminum-based alloy of claim 8 further including not more than about 0.08% by weight of iron and not more than about 0.06% by weight of silicon.

12. The alloy of claim 1, wherein said copper is between about 3.85 and 5.50 weight percent and said magnesium is between about 0.10 and 0.80 weight percent.

13. The alloy of claim 1, wherein said copper is between about 3.15 and 4.85 weight percent and said magnesium is between about 0.80 and 1.60 weight percent.

14. The alloy of claim 1, wherein said copper is between about 2.50 and 4.15 weight percent and said magnesium is between about 1.60 and 2.30 weight percent.

* * * * *